US005681361A

United States Patent [19]

Sanders, Jr.

[11] Patent Number: 5,681,361

[45] Date of Patent: Oct. 28, 1997

[54] METHOD OF MAKING AN ABRASIVE ARTICLE AND ABRASIVE ARTICLE PRODUCED THEREBY

[75] Inventor: Rufus C. Sanders, Jr., Burnsville, Minn.

[73] Assignee: Minnesota Mining and Manufacturing Company, St. Paul, Minn.

[21] Appl. No.: 583,990

[22] Filed: Jan. 11, 1996

[51] Int. Cl.[6] ..... B24D 3/02

[52] U.S. Cl. ..... 51/295; 51/298

[58] Field of Search ..... 51/293, 295, 298

[56] References Cited

U.S. PATENT DOCUMENTS

| | | |
|---|---|---|
| 2,375,585 | 5/1945 | Rimer . |
| 2,958,593 | 11/1960 | Hoover et al. . |
| 3,175,331 | 3/1965 | Klein . |
| 3,223,575 | 12/1965 | Griswold . |
| 3,418,187 | 12/1968 | Reeder et al. . |
| 4,150,514 | 4/1979 | Douglass . |
| 4,457,793 | 7/1984 | Buck, Jr. . |
| 5,178,646 | 1/1993 | Barber, Jr. et al. . |
| 5,306,319 | 4/1994 | Krishnan et al. . |

FOREIGN PATENT DOCUMENTS

| | | |
|---|---|---|
| 74768 | 11/1990 | Japan . |
| WO94/04598 | 3/1994 | WIPO . |
| WO95/16814 | 6/1995 | WIPO . |

*Primary Examiner*—Deborah Jones

*Attorney, Agent, or Firm*—Gary L. Griswold; Walter N. Kirn; Daniel R. Pastirik

[57] ABSTRACT

A method for making an abrasive article is described including the steps of providing an organic substrate; contacting the organic substrate with dry particulate solid material comprising a binder material, the binder material comprising a plurality of fusible organic particles, and a plurality of abrasive particles; inducing the fusible organic particles to liquefy; and solidifying the organic particles to thereby bond the particles to the organic substrate to provide an abrasive article. The invention provides a facile method for bonding abrasive particles to an organic substrate while reducing emissions at processing.

20 Claims, No Drawings

METHOD OF MAKING AN ABRASIVE ARTICLE AND ABRASIVE ARTICLE PRODUCED THEREBY

The invention is generally related to a method of making an abrasive article in which abrasive particles are bonded to an organic substrate without the presence of liquid organic solvents, and the product of the method.

BACKGROUND OF THE INVENTION

Nonwoven abrasive articles have been made of nonwoven webs constituted of a network of synthetic fibers or filaments which provide surfaces upon which abrasive particles are adhesively attached.

Nonwoven abrasive articles have employed a "make" coat of resinous binder material in order to secure the abrasive particles to the fiber or filament surface backing as the particles are oriented on the backing or throughout the lofty fibrous mat. A "size" coat of resinous binder material also has been applied over the make coat and abrasive grains in order to anchor and reinforce the bond of the abrasive particles to the backing or fibrous mat. A conventional sequence of fabrication steps for making nonwoven abrasive articles involves: first applying the make coat and abrasive particles to the backing or lofty fibrous mats; partially curing the make coat; applying the size coat; and, finally, the make and size coats are fully cured. In conventional practice, the size coat resin and the make coat resin can be the same type of resin or different resin materials.

Thermally curable binders have been used in such make and size coats as they provide abrasive articles having excellent properties, e.g., enhanced heat resistance. In order to render the resin precursors coatable, obtain the proper coating viscosities, and obtain defect free coatings, solvent is commonly added to the uncured resins. Conventional thermally curable resins include phenolic resins, urea-aldehyde resins, urethane resins, melamine resins, epoxy resins, and alkyd resins. Among these, phenolic resins have been used extensively to manufacture abrasive articles because of their thermal properties, availability, low cost, and ease of handling.

There are two basic types of conventional phenolic resins: resole and novolac phenolic resins. In formulating the phenolic resins, the monomers currently used in greatest volume are phenol and formaldehyde. Other noteworthy starting materials are the alkyl-substituted phenols, including cresols, xylenols, p-tert-butyl-phenol, p-phenylphenol, and nonylphenol. Diphenols, e.g., resorcinol (1,3-benzenediol and bisphenol-A (bis-A or 2,2-bis(4-hydroxyphenyl) propane), are employed in smaller quantities for applications requiring special properties. Molecular weight advancement and curing of resole phenolic resins are catalyzed by alkaline catalysts. The molar ratio of aldehyde to phenol is greater than or equal to 1.0, typically between 1.0 and 3.0.

In the production of adhesive coatings for nonwoven abrasive articles, one standard starting phenolic resin composition is a 70% solids condensate of a 1.96:1.0 formaldehyde:phenol mixture with 2% potassium hydroxide catalyst added based on the weight of phenol. The phenolic component of the phenolic resin is typically solid and requires the addition of solvent to render it soluble to react with the formaldehyde. The phenolic resin composition is typically 25–28% water and 3–5% propylene glycol ether to reduce the viscosity of the resin. Before this resin is used as a make or size coat, i.e., to make it coatable, further viscosity reduction is often achieved using VOC (i.e., a volatile organic compound). A conventional phenolic resin make coat may contain up to 40% of a VOC, such as isopropyl alcohol, to reduce viscosity and make the phenolic compatible with resin modifiers (flexibilizers), while a size coat might contain up to 20% of a VOC, such as diethylene glycol ethyl ether. Unreacted phenol and formaldehyde in the final, cured resin also contribute to VOC.

When polyester or cellulose backings or lofty fibrous mats are used in making nonwoven abrasive articles, curing temperature is sometimes limited to about 130° C. At this temperature, the protracted cure time and the solvent removal necessitate the use of festoon curing areas. Disadvantages of festoon curing areas include the emission of the volatile organic compounds, such as solvents, unreacted resin precursors such as phenol, formaldehyde and the like.

In order to reduce emissions of VOC, progress has been made to modify suitable resin systems to replace organic solvents with water, as described in U.S. Pat. Nos. 5,178,646 (Barber et al.) and 5,306,319 (Krishnan et al.). An alternative to this approach has been to employ so-called "100% convertible" or "100% solids" bond systems. Such alternative systems include the use of ethylenically-unsaturated bond systems that may be cured via UV irradiation. Such systems, however, are difficult to employ in the manufacture of nonwoven abrasive articles because the three-dimensional nature of nonwoven products causes "shadowing" wherein the interior fibers of the nonwoven substrate are partially covered by the outermost fibers, making uniform exposure to radiation (e.g., ultraviolet) emitted from a suitable source very difficult.

U.S. Pat. No. 2,958,593 (Hoover et al.) discloses a low density, open, nonwoven fibrous abrasive article. Organic fibers are adhesively bonded together at their mutual contact points, with abrasive particles are adhesively bonded to the web fibers. The interstices between the fibers are left open and untitled by adhesive or abrasive particles so that the web is non-clogging and non-filling in nature, and it consequently can be readily cleaned upon flushing. The adhesive used to bond the fibers in the web can also be used to attach the abrasive particles to the fibers. The adhesive is applied to the web as admixed with the abrasive particles in the form of an abrasive slurry. Alternatively, the adhesive can be applied to the web in a separate step from the deposition of the abrasive particles upon the web. Also, the adhesive used to bond the fibers together may be a separate type of binder from the type of binder used to bind the abrasive grit to the fibers. The fiber and abrasive adhesive(s) are applied to the nonwoven web as particle suspensions in an organic solvent by spraying, roll coating, or dip coating, and then the coated web is oven dried and cured to a non-tacky state. The arrangement described by Hoover et al. results in added costs and effort associated with providing appropriate processing precautions and waste handling/disposal equipment to contend with VOC emissions generated during heat cure of the adhesive. Also, the abrasive web fabrication process generally needs to be run in a generally continuous and non-interrupted manner through cure since the adhesive-coated intermediate web product will be tacky in nature, and thus it is troublesome to handle or store for an extended period of time.

U.S. Pat. No. 3,175,331 (Klein) discloses a cleaning and scouring pad comprising one or more fibrous batts, heat-sealed to be capable of having enclosed therein a solid washing composition, and in which the outer surface of the pad has grit adhered thereto to provide a continuous, uninterrupted scouring surface extending over the entire outer surface of the pad. A fusible adhesive in liquid form is applied on either surface of the fibrous layer sufficient to bond the fibers together to form a self-sustaining batt, where the amount of adhesive is desirably regulated to concentrate the adhesive in the area of the surface of the batt instead of the center of the batt to preserve loft, among other things. Abrasive grit is embedded in the impregnating adhesive applied to at least one surface of the fibrous batt.

U.S. Pat. No. 4,486,200 (Heyer et al.) discloses a method of interbonding an opened tow of filaments in forming an abrasive scouring pad by coating the tow with liquid resin drops in a step prior to depositing an abrasive powder onto the tow, or by autogenous fiber bonding.

U.S. Pat. No. 2,375,585 (Rimer) discloses, in one embodiment thereof, a method for making an fibrous abrasive scouring pad where abrasive particles are sprayed onto still molten surfaces of fleshly extruded synthetic filaments.

The use of fusible dry powders for the bonding of web fibers has been disclosed.

For example, U.S. Pat. No. 3,223,575 (Griswold) discloses a nonwoven sheet material that is inherently self-heat-sealable, which is capable of being laminated to a textile base sheet material, such as a textile garment, without undesirably stiffening the same or causing any material loss in flexibility therein. The flexible nonwoven sheet has openings provided completely through its thickness. A thermoplastic, potentially adhesive granular substance capable of being activated or rendered tacky and adhesive in the lamination process is deposited on the apertured nonwoven sheet. The openings in the nonwoven sheet are sized larger than the thermoplastic granules so that the openings remain open and unobstructed by the thermoplastic granules. As a consequence, the openings in the nonwoven are not subsequently sealed to the base sheet material when the thermoplastic granules are activated and the nonwoven and base sheets united to thereby provide a discontinuous bond therebetween and thus impart flexibility in the laminate.

U.S. Pat. No. 4,457,793 (Buck, Jr.) discloses a completely dry method for producing a fibrous batt by contacting fibers with particles of a vinyl chloride/diester of a vinyl unsaturated dicarboxylic acid copolymer. The fibers containing the copolymer particles are formed into a batt, and the batt is heated to a temperature above the melting point of the copolymer but below the scorching or melting point of the fibers, and then the batt is cooled to bond the fibers at their intersections.

PCT International Public. No. WO 95/16814 (McKay) describes a powder coating method for producing a composite web. A moist fabric of multifilament bundles is coated with a particulate solid material, which is fused and solidified to produce a fiber-reinforced composite web. The coated fabric is heated at temperature and for a time sufficient to effect encapsulation of the web filaments by the resinous material.

U.S. Pat. No. 3,418,187 (Reeder et al.) discloses a process for making a filter element where a fusible powder material is applied to continuous filaments, such as in the form of a opened tow, or staple fibers, such as in the form of a carded web, then the filaments or fibers are condensed into a cylindrical shape which is subjected to heat in order to fuse the bonding agent. The fusible powder preferably melts at a temperature which is less than the melting point or softening temperature of the filaments or fibers. The filaments or fibers are bonded together at various points throughout the filter element by the fusible powder upon application of the heat. If desired, soft powdery substances such as charcoal, activated clay or other aid to efficient filtration and absorption may be added as well as the bonding material, which will be incorporated within the finished filter rod.

There still remains a need for a technique to bond abrasive particles in a uniform manner to an organic substrate, such as fiber surfaces of a nonwoven abrasive article, that avoids the need for liquid organic solvents (viz., VOCs) and the processing complications and environmental concerns associated therewith.

SUMMARY OF THE INVENTION

The invention is generally related to a method of making an abrasive article where abrasive particles are adhesively attached in a uniform manner to an organic substrate that avoids the use of organic solvent compounds.

In one aspect, the invention provides a method for making an abrasive article comprising:

(a) contacting an organic substrate with dry particulate material comprising:
a plurality of fusible organic binder particles, and
a plurality of abrasive particles;

(b) liquefying said organic binder particles to provide a flowable liquid binder with said abrasive particles dispersed therein; and (c) solidifying said flowable liquid binder to bond said abrasive particles to said substrate.

The particulate material is "dry" in the sense that it include no substantial volatile, liquid organic solvents, which means that it is not used in conjunction with any such volatile, liquid organic solvents, such as volatile hydrocarbon solvents although minor amounts of residual entrapped solvents may be present. Therefore, VOC handling and disposal problems are reduced by the inventive method as the abrasive binder is used (from the time of application to the substrate through solidification) in a solvent-free or "neat" form. For purposes of this invention, the terminology "liquid organic solvent" means an organic compound that is liquid in the pure state at room temperature (i.e. about 25° C.). "Volatile" means a liquid that readily evaporates.

The organic substrate can be a fibrous substrate, such as woven, knitted, or nonwoven fabric. Alternatively, thermoplastic, thermosetting, or thermoplastic elastomeric foams can be used as the organic substrate. Preferably, the organic substrate is an open, lofty, three-dimensional nonwoven fabric, as described herein.

In another aspect, the invention provides a method for making a nonwoven fibrous abrasive article comprising:

(a) contacting an open, lofty nonwoven web of organic fibers with a dry particulate material comprising:
a plurality of fusible organic binder particles, and
a plurality of abrasive particles;

(b) liquefying the organic binder particles to provide a flowable liquid binder with said abrasive particles dispersed therein, said liquid binder and said abrasive particles dispersed along said fibers of said web; and (c) solidifying said flowable liquid binder to bond said abrasive particles to said fibers to provide the abrasive article.

The fibers of the nonwoven web are preferably bonded to one another at their mutual contact points by a cured "prebond" resin (e.g., a "prebond" web). However, webs comprising melt bondable fibers may also be used. Where melt bondable fibers are present, it becomes possible to even further reduce and possibly eliminate the need for the aforementioned prebond resin, thereby further reducing and possibly eliminating the need for VOCs in practicing the invention. The fusible organic particles and the abrasive particles may be physically preblended and applied as a single particulate solid mixture to the organic substrate, such as the fibers of a nonwoven article described above. Alternatively, the fusible organic particles and abrasive particles may be sequentially and separately applied to the organic substrate in any order. Preferably, the fusible organic particles are liquefied by heating for a sufficient time at an elevated temperature.

The distribution of the dry particulate material throughout the body of the nonwoven web will depend on the contemplated end use for the finished abrasive article. For example, it is possible to concentrate the dry particulate material in the surface areas of the nonwoven web. Alternatively, the dry particulate material can be uniformly distributed throughout the thickness of the web. The dry particulate material is preferably applied to the fibers of the nonwoven web so that the individual particles in the particulate material remain physically separated from one another and do not flow or otherwise merge together when liquefied to a molten or flowable condition on the fiber surfaces. In this manner, the binder material does not encapsulate the fibers, but when solidified, provides intermittent, localized bonding of the abrasive particles to the surfaces of the fiber and avoids the formation of adhesive clumps or of a continuous layer of binder. In this manner, the interstitial spaces between the fibers in the finished article remain substantially open and unfilled by the hardened binder.

In the present application, certain terms will be understood to have the meanings as set forth herein. "Fusible", in referring to a solid material, means the material is capable of achieving a flowable condition upon application of sufficient heat or other flow-inducing means (e.g., microwaves, infrared, ultrasonic forces, and combinations thereof) and which can then be resolidified (e.g., by cooling). The fusible solid organic binder particles can comprise a material which is fusible only once, e.g., a temperature-activated thermosetting resin particulate, or one that is potentially fusible many times as in the case of a thermoplastic resin particulate. For purposes of this invention, the fusible organic particles need only be fusible at least once to achieve the desired fiber and abrasive particle binding. "Liquefy" means a change the physical state of a material to that of a flowable liquid. "Solidify" means a change in the physical state of a material to a non-tacky solid and can include curing. "Curing" means causing cross-linking in a thermosetting resin. "Particulate" means small, separate solid particles which form a flowable dry mass in bulk.

The present invention requires no liquid materials and especially no organic solvents to achieve dispersion of the abrasive binder in desired regions of a nonwoven web. The use of the aforementioned fusible organic binder particles in the manufacture of an abrasive article allows for simplified processing while reducing overall emissions (e.g., VOCs) during such processing.

DETAILED DESCRIPTION OF THE PREFERRED EMBODIMENTS OF THE INVENTION

The invention provides a process for making an abrasive article where abrasive particles are firmly attached to an organic substrate by a dry, organic solvent-free technique.

The fusible organic material used as the binder material for the abrasive particles may be those of any suitable kind consistent with the requirement that it is capable of providing satisfactory abrasive particle-to-organic substrate surface bonding by being activated or rendered tacky at a temperature which avoids causing heat damage or disfiguration to the organic substrate, e.g., web fibers, to which it is to be adhered. The fusible organic particle materials meeting this criteria can be selected from among certain thermosetting particle materials, thermoplastic particle materials and mixtures of thermosetting and thermoplastic particle materials, as described herein.

The thermosetting particle systems involve particles made of a temperature-activated thermosetting resin. Such particles are used in a solid granular or powder form. The first or short-term effect of a temperature rise sufficiently above the glass transition temperature is a softening of the material into a flowable fluid-like state. This change in physical state allows the resin particles to mutually wet or contact the fiber surface and abrasive particles. Prolonged exposure to a sufficiently high temperature triggers the chemical reaction which forms a cross-linked three-dimensional molecular network that corresponds to a rigid plastic. The thus solidified (cured) resin particle locally bonds abrasive particles to the surface of a fiber. Useful temperature-activated thermosetting systems include formaldehyde-containing resins, such as phenol formaldehyde, novolac phenolics and especially those with added crosslinking agent (e.g., hexamethylenetetramine), phenoplasts, and aminoplasts; unsaturated polyester resins; vinyl ester resins; alkyd resins, allyl resins; furan resins; epoxies; polyurethanes; and polyimides.

In the use of heat-activated thermosetting fusible powders, the fusible organic powder is heated to at least its cure temperature to optimize the fiber and abrasive bonding. To prevent heat damage or distortion to the organic substrate, the cure temperature of the fusible thermosetting particle preferably will be below the melting point, and preferably below the glass transition temperature, of the fibers in the case of a fibrous substrate or that of the foam in the case of a foamed substrate.

Useful thermoplastic fusible organic materials as the binder material for the abrasive particles include polyolefin resins such as polyethylene and polypropylene; polyester and copolyester resins; vinyl resins such as poly(vinyl chloride) and vinyl chloride-vinyl acetate copolymers; polyvinyl butyral; cellulose acetate; acrylic resins including polyacrylic and acrylic copolymers such as acrylonitrile-styrene copolymers; and polyamides (e.g., hexamethylene adipamide, polycaprolactum), and copolyamides.

In the case of semi-crystalline thermoplastic particles (e.g., polyolefins, hexamethylene adipamide, polycaprolactum), it is preferred to heat the particles to at least its melting point whereupon the powder becomes molten to form a flowable fluid. More preferably, the melting point of crystalline thermoplastic fusible particles used will be one which is below the melting point and preferably below the glass transition temperature of the fibers, or it can be brought into this range by incorporation of plasticizer. Where noncrystallizing thermoplastics are used as the fusible particles of the bonding agent (e.g., vinyl resins, acrylic resins), the powders preferably are heated above the glass transition temperature and rubbery region until the fluid flow region is achieved.

Mixtures of the above thermosetting and thermoplastic particle materials may also be used in the invention.

The size of the fusible organic particles used as the binder for the abrasive particle material is not particularly limited. In general, the particle size of the fusible organic particles are less than about 1 mm in diameter, preferably less than about 500 micrometers in diameter. Generally, the smaller the diameter of the fusible organic particles, the more efficiently they may be rendered flowable because the surface area of the organic particles will increase as the materials are more finely-divided. When a fibrous substrate such as a nonwoven web is used, the fusible organic particles will preferably have a particle size small enough to permit penetration of the dry particles into the interstitial spaces between the fibers of the web.

Preferably, the amount of fusible organic particles applied to the organic substrate for purposes of binding the abrasive particle is adjusted to the minimum amount consistent with providing firm bonding of the abrasive particles to the organic substrate. Additional inter-fiber bonding may occur in fibrous substrates such as nonwoven webs as a consequence of some fusible organic particles contacting multiple fiber surfaces during the flowable state. Such additional bonding is desirable because it improves the integrity of the fibrous article.

The amount of fusible organic particle material used in the dry particulate material generally will be in the range from about 1 wt. % to about 99 wt. % resins, with the remainder comprising abrasive particles and optional non-resinous powdered substances (e.g., pigment powders). Preferred proportions of the components in the dry particulate material is about 10 to about 85 wt. % abrasive particles and about 90 to about 15 wt. % fusible organic particles, and more preferably about 70 to about 80 wt. % abrasive particles and about 30 to about 20 wt. % fusible organic particles.

Abrasive particles suitable for use in the present invention include all known abrasive materials as well as combinations and agglomerates of such materials. The abrasive particles may be of any size, from less than one micrometer in diameter to 2 mm or greater. Included among the various types of abrasive materials useful in the present invention are particles of aluminum oxide including ceramic aluminum oxide, heat-treated aluminum oxide and white-fused aluminum oxide; as well as silicon carbide, alumina zirconia, diamond, ceria, cubic boron nitride, garnet, and combinations of the foregoing. It is contemplated that abrasive agglomerates may also be used in the invention such as those described in U.S. Pat. Nos. 4,652,275 and 4,799,939, the disclosures of which are incorporated herein by reference. Useful abrasive particles may also include softer, less aggressive materials such as thermosetting or thermoplastic polymer particles as well as crushed natural products such as crushed nut shells, for example. Those skilled in the art will appreciate that the selection of particle composition and particle size will depend on the contemplated end use of the finished surface treating article, taking into account the nature of the workpiece surface to be treated by the article and the abrasive effect desired. The abrasive particles preferably will have a particle size small enough to allow penetration of the particles into the interstices of the nonwoven article. Chemically active particles may also be used alone or in combination with the aforementioned abrasive particles, including particles known to be effective as grinding aids such as those comprising poly (vinyl chloride) as well as particles providing effective lubricating properties in the finished article such as those comprising stearates of lithium and zinc, stearic acid and the like.

In a preferred embodiment, the fusible organic particles and the abrasive particles are physically preblended and applied as a single particulate mixture to the organic substrate, such as the fibers of a nonwoven web. Alternately, it is also possible to sequentially and separately apply the fusible organic particles and abrasive particles to the organic substrate, in any order.

The distribution of the mixture of the fusible organic particles and abrasive particles through the thickness of a nonwoven web, for example, can be varied depending on the contemplated end use of the finished abrasive article. For instance, it is possible to concentrate the mixture of fusible organic particles and abrasive particles in areas near the major surfaces of a nonwoven web relative to the center area of the nonwoven, or, alternatively, the mixture of fusible organic particles and abrasive particles can be uniformly distributed throughout the thickness of the web. Preferably, at least one of the opposite major surfaces of the nonwoven is penetrated by the mixture of fusible organic particles and abrasive particles to provide at least one abrasive surface on the finished article. In any event, the distribution of the abrasive particulate and their fusible organic particulate binder can be controlled to suit the contemplated use of the finished article in abrading, scouring and/or cleaning applications, for example.

The methods and equipment useful for applying the abrasive particles and fusible organic particles, as a blend or sequentially, to the organic substrate may be selected from among any of several known in the industry, such as indicated herein. Processes such as metering roll (e.g., a knurled roll powder applicator), powder spray, sifting, fluidized bed, or the like may be successfully employed in the practice of the present invention. In the selection of suitable equipment, it is preferred that the equipment is capable of homogeneously blending the dry particulate material and maintaining the homogeneity of the dry particulate material as it is delivered to the organic substrate. Accordingly, vibratory equipment is less preferred because its use may tend to segregate the flowable, hardenable resin powder particles from the much denser abrasive particles.

The organic substrate used as the support material for the abrasive particles can be a fibrous substrate, such as woven, knitted, or nonwoven fabric. For example, the fibrous substrates include woven, knitted, or nonwoven fabrics such as air-laid, carded, stitch-bonded, spunbonded, wet laid, or melt blown constructions. Alternatively, thermoplastic, thermosetting, or thermoplastic elastomeric foams can be used as the organic substrate. In the event that foam constructions are used, open-celled or reticulated foam structures are preferred.

In a preferred embodiment, the organic substrate is an open, lofty, three-dimensional nonwoven fabric, comprising a nonwoven web and fiber adhesive treatment (with no abrasive slurry treatment). The nonwoven web suitable for use in the articles of the invention may be made of an air-laid, carded, stitch-bonded, spunbonded, wet laid, or melt blown construction. A preferred nonwoven web is the open, lofty, three-dimensional air-laid nonwoven fabric described by Hoover et al. in U.S. Pat. No. 2,958,593, incorporated herein by reference. The nonwoven web comprises a first major web surface, a second major web surface opposite the first surface and a middle web portion extending between the first and second major web surfaces. The web may be made of any suitable fiber such as nylon, polyester, and the like, capable of withstanding the process temperatures to which the fusible organic particles are heated without deterioration. The fibers of the web are preferably tensilized and crimped but may also be continuous filaments formed by an extrusion process such as that described in U.S. Pat. No. 4,227,350 to Fitzer, incorporated herein by reference.

The fibers used in the manufacture of the nonwoven web include both natural and synthetic fibers and mixtures thereof. Synthetic fibers are preferred such as those made of polyester (e.g., polyester terephthalate), nylon (e.g., hexamethylene adipamide, polycaprolactum), polypropylene, acrylic (formed from a polymer of acrylonitrile), rayon, cellulose acetate, polyvinylidene chloride-vinyl chloride copolymers, vinyl chloride- acrylonitrile copolymers, and so forth. Natural fibers include those of cotton, wool, jute, and hemp. An important consideration in the selection of the fiber is that it does not melt or decompose at temperatures at or below the melting or curing temperature of the fusible organic particle used as the fiber and abrasive bonding agent. The fiber used may be virgin fibers or waste fibers reclaimed from garment cuttings, carpet manufacturing, fiber manufacturing, or textile processing, and so forth. The fiber material can be a homogenous fiber or a composite fiber, such as bicomponent fiber (e.g., a co-spun sheath-core fiber).

The fineness or linear density of the fiber used may vary widely, depending upon the results desired. Coarse fibers are generally more conducive to making pads for rough scouring jobs, while finer fibers are more appropriate for less aggressive scouring applications. Preferred fibers generally are those having a linear density from about 1 to 25 denier, although finer or coarser fibers may be used depending, for example, on the application envisaged for the finished abrasive article. Those skilled in the art will understand that the invention is not limited by the nature of the fibers employed or by their respective lengths, denier and the like.

The nonwoven web can be formed by a commercially available "Rando-Webber" device, such as obtained from Rando Machine Co., Macedon, N.Y. With such processing equipment, fiber length ordinarily should be maintained within about 1.25 cm to about 10 cm. However, with other types of conventional web forming equipment, fibers of different lengths, or combinations thereof also can be utilized to form the nonwoven webs. The thickness of the fibers is not particularly limited (apart from processing considerations), as long as due regard is given to the resilience and toughness ultimately desired in the resulting web. With the "Rando-Webber" equipment, fiber thickness is preferably within a range of about 25 to about 250 micrometers.

The fibers can be curled, crimped and/or straight. However, in the interest of obtaining a three dimensional structure with maximum loft and openness, it is preferable that all or a substantial amount of the fibers be crimped. It will be appreciated that crimping may be unnecessary where the fibers readily interlace with one another to form and retain a highly open lofty relationship in the formed web.

The fibers can be used in the form of a web, a batt, or a tow. As used herein, a "batt" is meant to refer to a plurality of air laid webs or similar structures.

As an optional enhancement to a nonwoven abrasive article made according to the invention, it is desirable to promote fiber bonding within the nonwoven web, so that the article will have greater structural strength. Such a fiber treatment can be imparted to the web, preferably as a separate treatment prior to or after the abrasive particles are adhesively attached to the fiber surfaces using the fusible organic particles. Known "prebond" resins devoid of abrasive components may be used to further consolidate nonwoven webs. The resinous adhesive is applied to the fibers of the air-laid web as a liquid coating using known coating or spraying techniques followed by hardening of the adhesive (e.g., by heat curing) to thereby bond the fibers of the web to one another at their mutual contact points. Suitable adhesive materials that can be used in this regard are known and include those described in U.S. Pat. No. 2,958,593 (Hoover et al.), incorporated herein by reference. Where melt bondable fibers are included within the construction of the nonwoven web, the fibers may be adhered to one another at their mutual contact points by an appropriate heat treatment of the web to melt at least one of the components of the fiber. The melted component performs the function of an adhesive so that, upon cooling, the melted component will resolidify and thereby form bonds at the mutual contact points of the fibers of the web. The inclusion of melt bondable fibers in a nonwoven web may or may not be accompanied by the application of a prebond resin, as known by those skilled in the art. The selection and use of melt bondable fibers, the selection and application of a prebond resin and the conditions required for bonding the fibers of a nonwoven to one another (e.g., by melt bonding or by prebond resin) are believed to be within the skill of those practicing in the field.

As mentioned, the fibers are bonded together at their mutual contact points to provide an open, low density, lofty web where the interstices between fibers are left substantially unfilled by resin or abrasive. For cleaning and scouring type applications, the void volume of the finished nonwoven abrasive article preferably is in the range of about 75% to about 95%. At lower void volumes, a nonwoven article has a greater tendency to clog-up which reduces the abrasive cutting rate and hinders cleaning of the web by flushing. If the void volume is too high, the web may lack adequate structural strength to withstand the stresses associated with cleaning or scouring operations.

It is also contemplated that the inventive method can be used for bonding abrasive particles to an opened tow of substantially parallel-arranged filaments as the nonwoven abrasive article. In this embodiment, a nonwoven abrasive cleaning and scouring pad, for example, can be formed by coating an opened tow of filaments with the fusible organic particles before or while depositing the abrasive particles on the tow. The fusible particles are then subjected to heat treatment to liquefy the particles and then solidified to fuse the abrasive particles to the filament surfaces, as described above.

One general scheme of the method of the invention involves the following. A nonwoven abrasive article is provided as either as continuous web or tow, or as a discrete web. In making production quantities, use of a continuous nonwoven will usually be more practical. The nonwoven web can be treated with a prebond adhesive as mentioned. The fusible organic particles, abrasive particles, plus any other optional dry particle adjuvants (such as pigment powder) are preferably premixed by any known particle or powder mixing means. Alternately, the different types of particles can be applied separately and sequentially to the nonwoven, if desired.

The particle blend can be drop coated, sprinkled, sprayed, or the like, in a dry condition upon a surface of the nonwoven, such as by conveying a nonwoven web beneath a particle dispenser. For example, a Schilling Roll coater (Schilling AG, Erlenbach, Switzerland) or a Nordsen Flexi Sprayer (Nordson Corp., Norcross, Ga.) can be used to apply the abrasive particles and fusible organic particles to a surface of a nonwoven web. After applying the particle blend to a surface of a nonwoven web, the nonwoven is exposed to a suitable heat source, such as infrared lamps, at a temperature sufficient to liquefy the fusible organic particles to a flowable condition. Heating can be accomplished with any suitable source providing sufficient heat distribution and air flow.

In the case of heat-activatable thermosetting particles, it is preferred that heating will initiate curing (cross-linking) of the fusible organic particle material and cause solidification of the organic particle material and mutual adhesion of contacted abrasive material and fiber surfaces. In the case of thermoplastic fusible organic particles, it is sufficient to heat the particles to a flowable state and then cool the web to thereby fuse the abrasive particles to the fibers. Where a nonwoven web is being used as the substrate for the article, one major surface of the web is first treated with the dry particulate material and heated. The web is then inverted and the opposite major surface of the web is similarly coated with dry particulate material and the thus treated web is again heat-treated to liquefy the resin as described.

In this manner, a nonwoven abrasive article can be made while avoiding the need to handle, store, and dispose of solvent containing resins and the potentially hazardous emissions created thereby. Also, if it is necessary or convenient to defer performing heat activation until a later time, the nonwoven web can be handled and stored after application thereto of dry particulate material. The abrasive articles of the invention can be used as cleaning or material removing tools, or as a primary component of such tools.

In the following nonlimiting examples, objects, features and advantages of this invention are further illustrated. All parts and percentages are by weight unless indicated otherwise.

EXAMPLES

The examples used the following materials, equipment, and test methods.

MATERIALS USED

Aluminum oxide: ANSI grade 280 & finer abrasive particles.

Phenol formaldehyde resin: "Durez 30485" molding powder, a novolac resin with hexamethylenetetramine crosslinking agent. 97% of the powder particles were less than 200 mesh (e.g., having a particle size within the range from about 60 to 66 micrometers). The resin is commercially available from Occidental Chemical Corp., Tonawanda, N.Y.

Styrene-butadiene latex resin: "Unocal Resin 76" SBR 5900, Unocal Polymers, Schaumburg, Ill.

Melamine crosslinker: "Cymel" 373, Cytec Industries, Inc., Wilmington, Del.

Catalyst: diammonium phosphate, 30% solution in water.

Surfactant: "Triton GR5" nonionic surfactant.

Antifoam compound: "Q2", Dow Corning Corp., Midland, Mich.

Thickener: "Methocel F4M" methyl cellulose solution, a 3% aqueous solution, Dow Chemical, Midland Mich.

Polyester fiber: 15 denier polyester fiber—Hoechst Type 294, 1.5" (38 mm) staple, Hoechst Celanese, Charlotte, N.C.

Thermally-bonding fiber: 15 denier melt bondable polyester fiber—"Celbond" type 254, a 15 denier×1.5" (38 mm) copolyester/PET (sheath/core) staple fiber, Hoechst Celanese, Charlotte, N.C.

EQUIPMENT

"Rando Webber": air-lay nonwoven web former from Rando Machine Co., Macedon, N.Y.

Knurled-roll powder applicator with counter-rotating brush stripper from Gessner, Inc. of Charlotte, N.C.

Nordson "Flexi Sprayer": a powder sprayer replumbed for user control and equipped with a standard bell shaped nozzle. The sprayer was available from Nordson Corp., Norcross, Ga.

TEST METHODS

Gardner Wear Test

The following accelerated wear test procedure was used to compare the abrasive webs of the examples. A "Gardner Heavy Duty Wear Tester No. 250", commercially available from Pacific Scientific, Gardner/Neotec Instrument Division, Silver Spring, Md., was provided with a clamping means to retain a 4"×26" (102 mm×660 mm) sheet of open mesh abrasive fabric (available under the trade designation "Wetordry Fabricut Type 21N", grade 32 silicon carbide from Minnesota Mining and Manufacturing Company, St. Paul, Minn.) and a stainless steel tray to retain water during wet testing. In operation, the testing machine was designed to apply a 2.5 kg downward load to the test specimen while linearly moving the test specimen left-to-right and right-to-left in contact with the abrasive mesh fabric at a rate of 45 full cycles per minute.

The open mesh abrasive fabric was clamped to the bottom of the test platform. Abrasive articles made according to the present invention were used as test specimens which were cut to dimensions 2.5"×9.25" (63.5×235 mm) and weighed to the nearest milligram. About one cup (approximately 240 milliliters) of water was poured into the test platform. A test specimen was placed on the immersed abrasive mesh fabric, the weight lowered onto it, and the machine started. After 200 cycles, the specimen was removed, dryed in a oven at 250° F. (121° C.) for 15 minutes, and weighed. Wear tests were conducted on two specimens for each example: one for each the top and bottom of the abrasive article. The percent wear was calculated with a correction for the worn area of the specimen. The percent wear was then calculated by the following equation:

$$\%\ \text{Wear}=\{([IW-FW]/IW)(\text{Area of Wear})(\text{Correction Factor})\}+4.27;$$

where:

IW=Initial weight;

FW=Final weight;

Area of Wear=2.54(100); and

Correction Factor=0.632.

Schiefer Cut Test

This test provided a measure of the cut (material removed from a work piece) and finish (the relative quality of the abraded surface) of coated abrasive articles under wet conditions. A 4-inch diameter circular specimen was cut from the abrasive material to be tested and secured by a pressure-sensitive adhesive to a back-up pad that has been preconditioned by soaking in water. The abrasive material was then pre-wetted by floating in water. The back-up pad was secured to the driven plate of a Schiefer Abrasion Tester (available from Frazier Precision Company, Gaithersburg, Md.) which has been plumbed for wet testing. A circular acrylic plastic work piece, 10.16 cm diameter by 1.27 cm thick, available as, "POLYCAST" acrylic plastic from Seelye Plastics, Bloomington, Minn. was employed. The initial weight of each work piece was recorded to the nearest milligram prior to mounting on the work piece holder of the abrasion tester. The water drip rate was set to 60±6 drops per minute. A 4.55 kg load was placed on the abrasion tester weight platform and the mounted abrasive specimen was lowered onto the work piece. The machine was set to run for 500 cycles and then automatically stop. After each 500 cycles of the test, the work piece was wiped free of water and debris and weighed. The cumulative cut for each 500-cycle test was the difference between the initial weight and the weight following each test.

If the finish of the work piece was to be determined, the abraded work piece was mounted in the specimen holder of a RANK SURTRONIC 3 Profilometer, available from Rank Taylor-Hobson, Leicester, England, and the surface profile is measured. $R_{tm}$, which was the mean of the maximum peak-to-valley values from each of 5 sampling lengths, was reported for each test.

Example 1

An air laid, nonwoven web weighing 30 grains/24 in$^2$ (126 g/m$^2$) and comprising 85% 15 denier×1.5 inch polyester staple fibers and 15% 15 denier×1.5 inch copolyester/PET (sheath/core) thermal bonding polyester staple fibers ("Celbond type 254" staple fibers) was formed on a "Rando Webber" forming machine. A powder composition comprising 75% grade 280 and finer aluminum oxide abrasive particles and 25% phenolic resin granules was then applied to one side of the web via the Nordson "Flexi Sprayer" powder spray gun to achieve an add-on weight of 45 to 95 grains/24 in$^2$ (189 to 398 g/m$^2$). The Flexi Sprayer provided an atomizing pressure of 1.05 kg/cm$^2$ (15 psi), a flow pressure of 0.84 kg/cm$^2$ (12 psi), a suspension pressure of 0.84 kg/cm$^2$ (12 psi) and a fluldizing pressure between 0.35 and 0.7 kg/cm$^2$ (5 to 10 psi). The thus treated web was heated for 45 seconds in a radiant oven having an element temperature of 775° to 840° F. (413° to 449° C.). The web was then inverted and an identical resin/abrasive coating was applied to the other side. The web was heated again under identical conditions. An additional sample was coated identically with the exception that the coating was achieved by a knurled-roll powder coater. Samples of each composition were tested for abrasive performance by the Schiefer Cut Test. The results are shown in Table 1. For comparative purposes, acceptable Schiefer Test results for this type of product is considered to be 2.7 to 3.0 grams.

TABLE 1

| Coating Method | No. of Samples | Ave. Total Wt., g/m$^2$ | Schiefer Cut, g. (one side) |
|---|---|---|---|
| Nordson spray | 3 | 506.32 | 2.89 |
| Nordson spray | 2 | 317.85 | 3.85 |
| Schilling roll | 2 | 333.02 | 3.07 |

The results summarized in Table 1 show the efficacy of the inventive method to manufacture an abrasive article from 100% solids materials without any solvents.

Example 2

A 30 grain/24 in$^2$ (126 g/m$^2$) air laid, nonwoven web of 15 denier×1.5 inch (3.81 cm) polyester staple fibers was prepared as in Example 1 with the exception that the thermal bonding fibers were omitted. The web was then roll coated with a styrene-butadiene latex resin (comprising 86.8% SBR latex, 8.7% crosslinker, 0.75% catalyst, 1.7% surfactant, 1% thickener, 1% green pigment, and 0.05% antifoam compound) and dried in an oven to achieve a dry add-on of 20 grains/24 in$^2$ (84 g/m$^2$). To this "prebond" web a powder blend of 75% grade 280 aluminum oxide and 25% novolac phenolic molding powder ("Bakelite") was applied via the "Flexi Spray" to the two sides of the web with heating as in Example 1 to provide a total add-on of 15 to 82 grains/24 in$^2$ (63 to 344 g/m$^2$). Each side of the was heated for a total of 45 seconds in a radiant oven with elements set progressively at 775° to 925° F. (413° to 496° C.) at a distance of 6 inches from the web (15 cm). Specimens from the composites of Example 2 were evaluated by the Schiefer cut test and the Gardner Wear testing. The results are presented in Table 2. All testing indicated that the abrasive articles have exceptional cut and acceptable useful life as indicated by the wear test.

TABLE 2

| Ave. Total Weight, g/m$^2$ | Mineral Weight, g/m$^2$ | Schiefer Cut, g (top/bottom) | Gardner Wear, g. (top/bottom) | Element Temp., (°C.) |
|---|---|---|---|---|
| 440 | 197 | 2.19/2.14 | 65.82/73.80 | 416–421 |
| 654 | 314 | 3.94/3.87 | 31.95/24.83 | 449 |
| 784 | 351 | 3.66/3.20 | 25.74/29.03 | 449 |
| 817 | 348 | 4.46/3.75 | 21.31/25.22 | 482 |
| 830 | 438 | 3.62/3.65 | 36.66/11.25 | 496 |

The results summarized in Table 2 demonstrates the utility of the present invention even when employed without the use of thermally bonded fibers.

While the invention has been described in terms of its preferred embodiments, those skilled in the art will recognize that the invention can be practiced with modification within the spirit and scope of the appended claims.

What is claimed is:

1. A method for making an abrasive article comprising:

(a) contacting an organic substrate with dry particulate material comprising:
a plurality of fusible organic binder particles, and
a plurality of abrasive particles;

(b) liquefying said organic binder particles to provide a flowable liquid binder with said abrasive particles dispersed therein; and (c) solidifying said flowable liquid binder to bond said abrasive particles to said substrate and to provide the abrasive article.

2. The method of claim 1, wherein said organic substrate comprises material selected from the group consisting of a fibrous substrate and a foam.

3. A method for making a nonwoven fibrous abrasive article comprising:

(a) contacting an open, lofty nonwoven web of organic fibers with a dry particulate material comprising:
a plurality of fusible organic binder particles, and
a plurality of abrasive particles;

(b) liquefying the organic binder particles to provide a flowable liquid binder with said abrasive particles dispersed therein, said liquid binder and said abrasive particles dispersed along said fibers of said web; and (c) solidifying said flowable liquid binder to bond said abrasive particles to said fibers and to provide the abrasive article.

4. The method of claim 3, wherein said fusible organic binder particles comprise materials selected from the group consisting of temperature-activated thermosetting materials and thermoplastic materials.

5. The method of claim 3, wherein said fusible organic binder particles comprise temperature-activated thermosetting particles.

6. The method of claim 3, wherein said fusible organic binder particles comprise organic binder selected from the group consisting of phenol formaldehyde resins, phenoplasts, aminoplasts, unsaturated polyester resins, vinyl ester resins, alkyd resins, allyl resins, furan resins, epoxies, polyurethanes, and polyimides.

7. The method of claim 3, wherein said fusible organic binder particles comprise organic binder temperature-activated thermosetting resin, and said liquefying comprises heating said fusible organic binder particles at a temperature sufficient to cause said organic binder to flow and said solidifying comprises heating said organic binder at a temperature equal to or greater than the curing temperature thereof.

8. The method of claim 7, wherein said heating temperature is lower than melting temperature of said organic fibers.

9. The method of claim 3, wherein said fusible organic binder particles comprise thermoplastic particles.

10. The method of claim 3, wherein said fusible organic binder particles comprise organic binder selected from the group consisting of polyolefin resins, vinyl resins, cellulosic resins, acrylic resins, polyamides, polyesters, copolyesters and mixtures thereof.

11. The method of claim 3, wherein said fusible organic binder particles have an average particle size less than about 1 mm.

12. The method of claim 3, wherein said organic binder particles comprise between about 90 wt. % and 15 wt. % of the total weight of said dry particulate material.

13. The method of claim 3, wherein said abrasive particles and said fusible organic binder particles are applied to said open, lofty nonwoven web in step (a) as a dry blend containing from about 70 to about 80 wt. % abrasive particles and from about 30 to about 20 wt. % fusible organic binder particles.

14. The method as in claim 3, wherein said abrasive particles comprise material selected from the group consisting of aluminum oxide, coal slag, flint, silicon carbide, garnet, silica, talc, glass, metal particles, and granite.

15. The method of claim 3, wherein said organic fibers are selected from the group consisting of natural fibers, synthetic fibers, and mixtures thereof.

16. The method of claim 3, wherein said organic fibers comprise material selected from the group consisting of polyester, polyamide, polypropylene, acrylic, rayon, cellulose acetate, polyvinylidene chloride-vinyl chloride copolymer, vinyl chloride-acrylonitrile copolymer, and mixtures thereof.

17. The method of claim 3, wherein said organic fibers have a linear density ranging from 1 to 25 denier.

18. The method of claim 3, further comprising bonding said fibers to one another at their mutual contact points prior to contacting said web with said dry particulate material.

19. The method of claim 18 wherein said bonding is accomplished by applying a liquid adhesive to said fibers and hardening said adhesive to bond said fibers.

20. The method of claim 18, wherein at least a portion of said fibers are melt-bondable fibers and wherein said bonding is accomplished by heating said fibers to partially melt a component thereof, and cooling to solidify said component and bond said fibers to one another.

* * * * *